United States Patent [19]

Thomas

[11] 4,074,676

[45] Feb. 21, 1978

[54] WATER HEATER-FIREPLACE GRATE

[76] Inventor: Donald Richard Thomas, 206 Tule St., Montoursville, Pa. 17754

[21] Appl. No.: 690,973

[22] Filed: May 28, 1976

[51] Int. Cl.[2] ..... F24B 9/04

[52] U.S. Cl. ..... 126/132; 126/164

[58] Field of Search ..... 126/132, 133, 164, 165, 126/336

[56] References Cited

U.S. PATENT DOCUMENTS

| | | | |
|---|---|---|---|
| 114,280 | 5/1871 | Farris | 126/132 X |
| 463,061 | 11/1891 | Lewis | 126/132 |
| 670,066 | 3/1901 | Smoak | 126/132 |
| 1,252,176 | 1/1918 | Read | 126/132 |
| 1,426,976 | 8/1922 | Gabet | 126/132 |
| 2,052,643 | 9/1936 | Modine | 126/121 |
| 2,172,711 | 9/1939 | Newton | 126/132 |

*Primary Examiner*—John J. Camby

*Assistant Examiner*—Larry I. Schwartz

*Attorney, Agent, or Firm*—Robert K. Youtie

[57] ABSTRACT

The invention relates to a fireplace grate having water passage means therethrough for connection in a water heating system to utilize fireplace heat to heat water, and includes a plurality of generally coplanar substantially horizontal bed pipes for supporting burning fuel, an ingress and egress pipe extending laterally across and connected in fluid communication to at least certain of the bed pipes for passing fluid to and receiving fluid from the latter, rear pipes upstanding from the bed pipes and connected in fluid communication with at least said certain bed pipes, and heat collection means extending from the rear pipes spacedly over the bed pipes and having fluid passage means communicating with the rear pipes, so that fluid is adapted to be heated upon passage through the grate.

6 Claims, 4 Drawing Figures

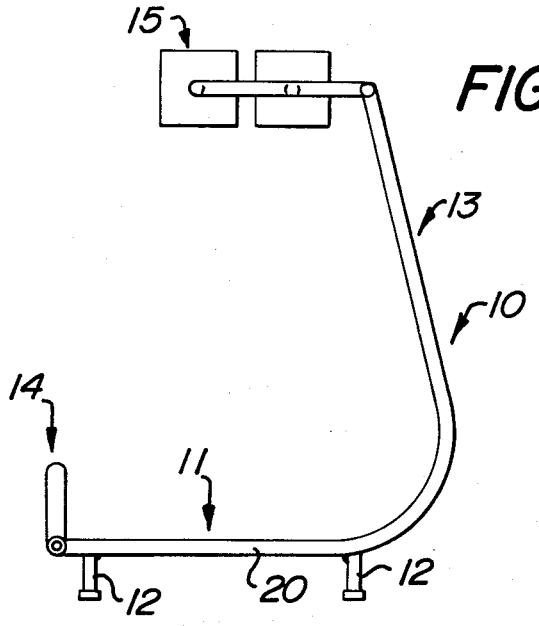
FIG. 1
FIG. 2
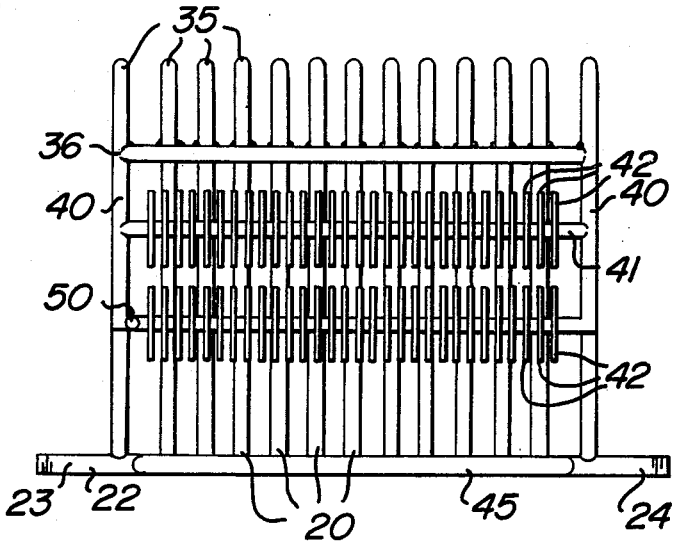
FIG. 3
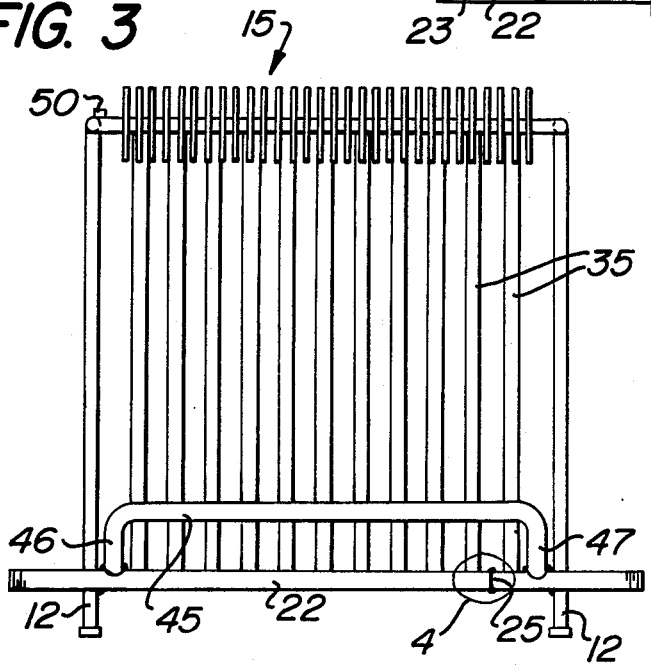
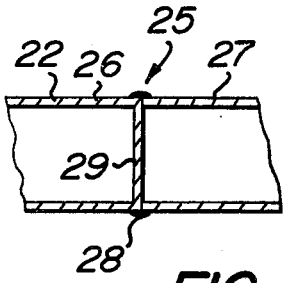
FIG. 4

WATER HEATER-FIREPLACE GRATE

BACKGROUND OF THE INVENTION

While they have, in the past, been proposed a variety of fireplace grates composed of hot water pipes for heating water in a water system, such prior constructions have not found wide general acceptance for many reasons. For example, prior water pipe fireplace grates have been thermally inefficient, so as to not justify the expense of purchase and installation, and have required relatively complex construction involving substantial manufacturing costs and being subject to undesired malfunction and deterioration.

SUMMARY OF THE INVENTION

It is, therefore, an important object of the present invention to provide a water heater-fireplace grate which overcomes the above-mentioned difficulties, produces a high thermal efficiency so as to effect considerable savings in fuel costs enabling relatively quick return of initial expenditure.

It is still another object of the present invention to provide a water heater-fireplace grate having the advantageous characteristics mentioned in the preceding paragraph which is extremely simple in design, staunch and durable in construction, and highly reliable in performance throughout a long useful life.

Other objects of the present invention will become apparent upon reading the following specification and referring to the accompanying drawings, which form a material part of ths disclosure.

BRIEF DESCRIPTION OF THE DRAWINGS

FIG. 1 is a side elevational view showing a water heater-fireplace grate constructed in accordance with the teachings of the present invention.

FIG. 2 is a top view of the construction of FIG. 1.

FIG. 3 is a front elevational view, as taken from the left-hand side of FIG. 1.

FIG. 4 is an enlarged, sectional view illustrating the encircled area designated 4 in FIG. 3.

DESCRIPTION OF THE PREFERRED EMBODIMENT

Referring now more particularly to the drawings, and specifically to FIGS. 1-3 thereof, a water heater-fireplace grate of the present invention is there generally designated 10, and is constructed essentially of hollow tubing of pipe fabricated of heat conductive material, such as metal. Any suitable metal may be employed, as desired.

The device 10 includes a generally horizontal lower fuel support region or bed 11 adapted for location in spaced relation over a fireplace hearth, being supported thereon by suitable legs, such as at 12 depending from the bed 11. Upstanding from a rearward region of the bed 11 is a rear grate region or back 13, for location adjacent to the rear wall of a fireplace. A forward retainer or rail 14 upstands from a front region of the bed 11, the forward retainer and back 13 combining to hold logs, coals or other fuel on the bed in position to be burned. In addition, projecting forwardly from an upper region of the grate back 13 is a heat collector, generally designated 15, which is located in vertically spaced relation over the fuel bed 11, all for purposes appearing more fully hereinafter.

The bed 11 may be composed of a plurality of generally horizontally disposed, parallel spaced, forwardly and rearwardly extending elongate tubular members or pipes 20. The pipes 20 combine to define the bed 11, and may be considered as bed pipes.

Extending laterally across the bed pipes 20, generally normal to the latter and specifically transversely across the front ends of the pipes 20 is an ingress and egress pipe 22 for connection in a hot water system, say of the domestic type. In particular, the inress and egress pipe 22 extends laterally across and has its opposite ends 23 and 24 extending beyond the laterally outermost bed pipes 20, while the forward ends of the several bed pipes are suitably fixedly secured, as by welding, brazing or other suitable securing means, to the horizontal front pipe 22. At least certain of the bed pipes 20 are connected to open interiorly into the interior of the ingress and egress pipe 22, and advantageously all of the bed pipes are so connected in fluid communication with the interior of the ingress and egress pipe. At one location along the ingress and egress pipe 22 there is provided an internal closure, occluding obstruction or dam 25, see FIGS. 3 and 4. In the enlargement of FIG. 4 it may be seen that the ingress and egress or front pipe 22 may be of sectional construction, including a pair of end-to-end aligned sections 26 and 27 joined together by a weld 28 or other suitable means, and provided at their juncture with a transverse wall 29 defining the occluding obstruction. The obstruction is located between an adjacent pair of bed pipes 20, for reasons appearing presently.

The grate back wall 13 may be defined by a plurality of generally parallel, upstanding rear pipes 35 which extend upwardly from the rear ends of respective bed pipes 20. The back wall 13 may further include a generally horizontal, laterally extending upper pipe 36 extending across and connected to the upper ends of the several rear pipes 35. The upper horizontal pipe 36 is connected in fluid communication with at least certain of the rear pipes 35 on opposite sides of the obstruction or closure 25, and may preferably be connected in fluid communication with the upper ends of all the rear pipes.

The heat collection means 15 may include a pair of forwardly extending pipes 40, respectively projecting generally horizontally forwardly from opposite ends of the upper horizontal pipe 36 and in fluid communication therewith. The pipes 40 are thus located in spaced relation over opposite side regions of the bed 11, in substantial parallelism with each other. Extending generally horizontally between the side pipes 40 are a pair of heat collector pipes 41 extending laterally of and spacedly over the bed 11 in substantial coplanarity with the side pipes 40 and upper lateral pipe 36. The heat collection pipes 41 provide parallel fluid paths between side pipes 40, and are each advantageously provided with a plurality of generally vertically disposed heat collector plates or fins 42. That is, the heat collector plates or fins 42 extend in parallelism with each other, spaced along the laterally extending heat collection pipes 41, generally normal thereeto and located directly over the bed 11 for collecting heat from fire on the bed and gaseous combustion products passing upwardly through the heat collection means 15.

The legs of feet 12 depend from laterally outermost bed pipes 20, or other suitable downwardly facing structure, for supporting the bed in spaced relation over a fireplace hearth. In this manner, coals or embers on the hearth deliver heat upwardly to the under surfaces of the bed pipes 20.

The forward retaining rail 14 includes a hollow pipe 45 extending longitudinally along and spaced over the laterally extending ingress and egress pipe 22, intermediate the ends of the latter 23 and 24. Further, opposite end regions of the retaining pipe or rail 45 may be bent downwardly, as at 46 and 47 with their lower ends secured to adjacent regions of the ingress and egress pipe 22. If desired, the forward retaining rail 14 may be of hollow construction, having its opposite ends in fluid communication with the ingress and egress pipe 22 on opposite sides of the obstacle 24, as seen in FIG. 3. Hence, the rail provides still additional fluid passage means between the opposite ends of the ingress and egress pipe 22 affording heat transfer to contain fluid from a fire on the bed 11.

As installed, the water heater-fireplace grate 10 is connected in the hot water line of a domestic water system, in any suitable manner, so that water passes through the several pipes of the grate, being heated during passage, for exit at an elevated temperature in the hot water system. Should the system be closed and it be desired to eliminate air from the system, suitable air vent means may be provided, as at 50, permitting the escape of air from an upper region of the grate construction.

From the foregoing it will now be appreciated that a uniquely advantageous construction of water heater-fireplace grate is provided by the instant invention affording an extremely high heat transfer area for its size, so as to effectively collect all possible heat from a fireplace fire in the hot water system, and which otherwise fully accomplishes its intended objects.

Although the present invention has been described in some detail by way of illustration and example for purposes of clarity of understanding, it is understood that certain changes and modifications may be made within the spirit of the invention.

What is claimed is:

1. A water heater-fireplace grate comprising a plurality of forwardly and rearwardly extending generally horizontal bed pipes disposed in generally coplanar relation and providing a fuel supply bed, an ingress and egress pipe extending laterally across the forward ends of said bed pipes and in fluid communication with at least certain and less than all of the latter for feeding fluid thereto and in fluid communication with other of the bed pipes for receiving fluid therefrom, a plurality of rear pipes upstanding from the rear regions of said bed pipes, certain of said rear pipes being in fluid communication with said certain bed pipes to receive fluid therefrom and other of said rear pipes being in fluid communication with said other of said bed pipes to feed fluid thereto, and heat collection means extending from said rear pipes in spaced relation over said bed pipes, said heat collection means having fluid passageway means communicating between said certain rear pipes for passing fluid between said certain bed pipes, whereby fluid is adapted to be heated upon passage through said grate.

2. A water heater-fireplace grate according to claim 1, in combination with an obstruction in said ingress and egress pipe between its connection to said certain and other bed pipes, for passing all fed fluid through said certain bed pipes and withdrawing all fluid through said other bed pipes.

3. A water heater-fireplace grate according to claim 2, said ingress and egress pipe being connected to the forward ends of said bed pipes and having its ends extending beyond the bed pipes for connection to a fluid system.

4. A water heater-fireplace grate according to claim 1, said heat collection means comprising a pair of parallel connected upper pipes extending laterally across the upper regions of and connected in fluid communication with said certain and other rear pipes for passing fluid therebetween, said upper pipes being located directly over said bed pipes, and heat conductive fins disposed generally vertically on said uper pipes for receiving maximum heat without appreciably obstructing draft.

5. A water heater-fireplace grate according to claim 4, in combination with legs depending from said bed pipes for supporting the latter in spaced relation over a hearth; said bed, ingress and egress and rear pipes being fabricated of heat conductive material for transferring heat from a fire to fluid within said pipes.

6. A water heater-fireplace grate according to claim 5, said ingress and egress pipe being connected to all of said bed pipes, and said upper pipe being connected to all of said rear pipes for maximum heat transfer through said pipes to contain fluid.

* * * * *